US006480164B2

(12) United States Patent
Posner et al.

(10) Patent No.: US 6,480,164 B2
(45) Date of Patent: Nov. 12, 2002

(54) CORRECTIVE DIELECTRIC LENS FEED SYSTEM

(76) Inventors: Ronald S. Posner, 5321 NE. Second La., Ocala, FL (US) 34470; Leslie D. Spivey, 4934 SE. 166th St., Summerfield, FL (US) 34491; Tore N. Anderson, 49 High Ridge Rd., Brookfield, CT (US) 08804; Steven Galagen, 3102 Seaway Ct., Apt. 304, Tampa, FL (US) 33679

( * ) Notice: Subject to any disclaimer, the term of this patent is extended or adjusted under 35 U.S.C. 154(b) by 0 days.

(21) Appl. No.: 09/921,336

(22) Filed: Aug. 2, 2001

(65) Prior Publication Data

US 2002/0053993 A1 May 9, 2002

Related U.S. Application Data

(60) Provisional application No. 60/223,103, filed on Aug. 3, 2000.

(51) Int. Cl.[7] ..... H01Q 13/00
(52) U.S. Cl. ..... 343/772; 343/911 R
(58) Field of Search ..... 343/772, 786, 343/909, 911 R

(56) References Cited

U.S. PATENT DOCUMENTS

| | | | | |
|---|---|---|---|---|
| 2,609,505 A | | 9/1952 | Pippard | 343/754 |
| 3,389,394 A | | 6/1968 | Lewis | 343/725 |
| 3,414,903 A | | 12/1968 | Bartlett | 343/753 |
| 3,434,146 A | | 3/1969 | Petrich | 343/753 |
| 3,438,041 A | | 4/1969 | Holtum, Jr. | 343/779 |
| 3,573,833 A | | 4/1971 | Ajioka et al. | 343/753 |
| 3,611,392 A | | 10/1971 | Knox | 343/755 |
| 3,624,655 A | | 11/1971 | Sato et al. | 343/756 |
| 3,795,002 A | * | 2/1974 | Nemit | 343/754 |
| 4,511,868 A | | 4/1985 | Munson et al. | 333/257 |
| 4,636,798 A | | 1/1987 | Seavey | 343/753 |
| 4,977,407 A | | 12/1990 | Crane | 343/753 |
| 5,017,937 A | | 5/1991 | Newham et al. | 343/785 |
| 5,248,987 A | | 9/1993 | Lee | 343/785 |
| 5,859,615 A | * | 1/1999 | Toland et al. | 343/753 |
| 6,075,497 A | | 6/2000 | Chen et al. | 343/840 |

* cited by examiner

*Primary Examiner*—Dong Wong
*Assistant Examiner*—Hoang Nguyen
(74) *Attorney, Agent, or Firm*—Allen, Dyer, Doppelt, Milbrath & Gilchrist, P.A.

(57) ABSTRACT

An apparatus for broadening the radiation pattern of a waveguide horn includes an input waveguide feed including a non-circular waveguide horn having a non-circular aperture, and a dielectric lens shaped as a toroid having an interior opening and an outside circumference, the toroid being cut along an imaginary plane extending generally parallel to a diameter of the toroid and being positioned generally coaxially adjacent the non-circular aperture.

11 Claims, 3 Drawing Sheets

CORRECTIVE DIELECTRIC LENS FEED SYSTEM

RELATED APPLICATION

This application claims priority from co-pending provisional application Ser. No. 60/223,103 which was filed on Aug. 3, 2000 and which is incorporated herein by reference in its entirety.

FIELD OF THE INVENTION

The present invention relates to the field of antennas and, more particularly, to an antenna feed system which corrects and improves the performance of antenna feeds used in parabolic antennas.

BACKGROUND OF THE INVENTION

In the simplest configuration, an antenna feed is located at the focal point of a parabolic dish antenna. The feed usually consists of a scalar plate, a circular or square waveguide input and a orthomode coupler of some kind. The orthomode coupler separates orthogonal electromagnetic fields such as vertical and horizontally polarized waves. When only one polarization is used, the waveguide input may be rectangular. The diameter of the circular or square waveguide input effectively controls the feed primary pattern, such as beam width and frequency response. The scalar plate helps the feed primary pattern E and H-plane cuts to coincide.

Once the frequency of the antenna is known, the diameter of the waveguide input is chosen to allow the electromagnetic wave to propagate. Hollow pipes, such waveguide, have a cut-off frequency for which propagation is allowed above a certain frequency known as the cut-off frequency. The cut-off frequency is directly related to the pipe circular diameter. For square or rectangular waveguide, the cut-off frequency is related to the side dimensions. As the diameter increases, the cut-off frequency decreases. At the same time, the feed primary pattern beam width is controlled by this same diameter. As the diameter increases, the primary pattern beam width decreases.

For parabolic antennas, the antenna designer uses the feed to illuminate the dish. The feed is located at the parabolic dish focal point and aimed at the dish center as shown in FIG. 1. In receiving applications, electromagnetic waves striking the dish are focused onto the feed. When transmitting, the power from the feed illuminates the dish. The feed and antenna behave the same independent of whether the dish and feed are used for transmitting or receiving. The feed designer tries to illuminate the dish in such a way as to make the primary pattern roll-off about 10 dB at the antenna edge. For satellite communications applications, the roll-off insures that the ground in not illuminated by an appreciable amount of the primary pattern power that spills off the parabolic dish edge. With a smaller roll-off, to much of the ground is illuminated making the antenna receive system noisy. With a larger roll-off, the dish is under illuminated making the dish gain low.

To help with the understanding of the feed design problem, let us first explore the antenna geometry schematically shown in FIG. 2. A parabolic dish antenna is defined by its focal length and diameter. Engineers define the parabolic geometry by the antenna f/d ratio where f is the focal distance and d is the dish diameter. The dish edge makes an angle A(x) with respect to the perpendicular from the dish center to focal point given by the following formula, where x is the f/d ratio. For small, f/d ratios usually encountered in satellite dish antennas, the edge angle is quite large.

$$A(x) = \operatorname{atan}\left(\frac{0.5}{x - \frac{1}{16x}}\right)$$

For f/d=0.3, A(0.3)=79.6 degrees.

For the above example, the feed designer's problem is roll-off the feed primary pattern approximately 10-dB at dish edge 79.6 degrees from the center of the dish. The problem the feed designer runs into however is related to the diameter of the feed input waveguide. With any choice of the feed input waveguide diameter above the cut-off frequency, the dish is usually not illuminated properly. Almost any choice of waveguide diameter makes the roll-off to large—on the order 18 to 25 dB. To broaden the primary feed pattern and reduce the roll-off, the feed designer then tries to do is to make the input waveguide diameter smaller. Before anything meaningful is achieved, the designer runs into the cut-off frequency. In summary, the problem is that the feed designer runs into the cut-off frequency before he can improve the roll-off.

BRIEF DESCRIPTION OF THE DRAWINGS

Some of the features, advantages, and benefits of the present invention having been stated, others will become apparent as the description proceeds when taken in conjunction with the accompanying drawings in which.

DESCRIPTION OF A PREFERRED EMBODIMENT OF THE INVENTION

With the foregoing in mind, the present invention advantageously provides a solution to the problem discussed above. In the present invention, the dielectric corrective lens broadens the primary pattern over the dish reducing the rate of the roll-off at the dish edge. Roll-off is reduced from approximately 20 dB to 10 dB. The pattern broadening behaves in the same way as the results from an antenna sub-reflector in two reflector antennas. With pattern broadening, from the corrective dielectric lens, antenna gain is remarkably improved.

Figure 1:
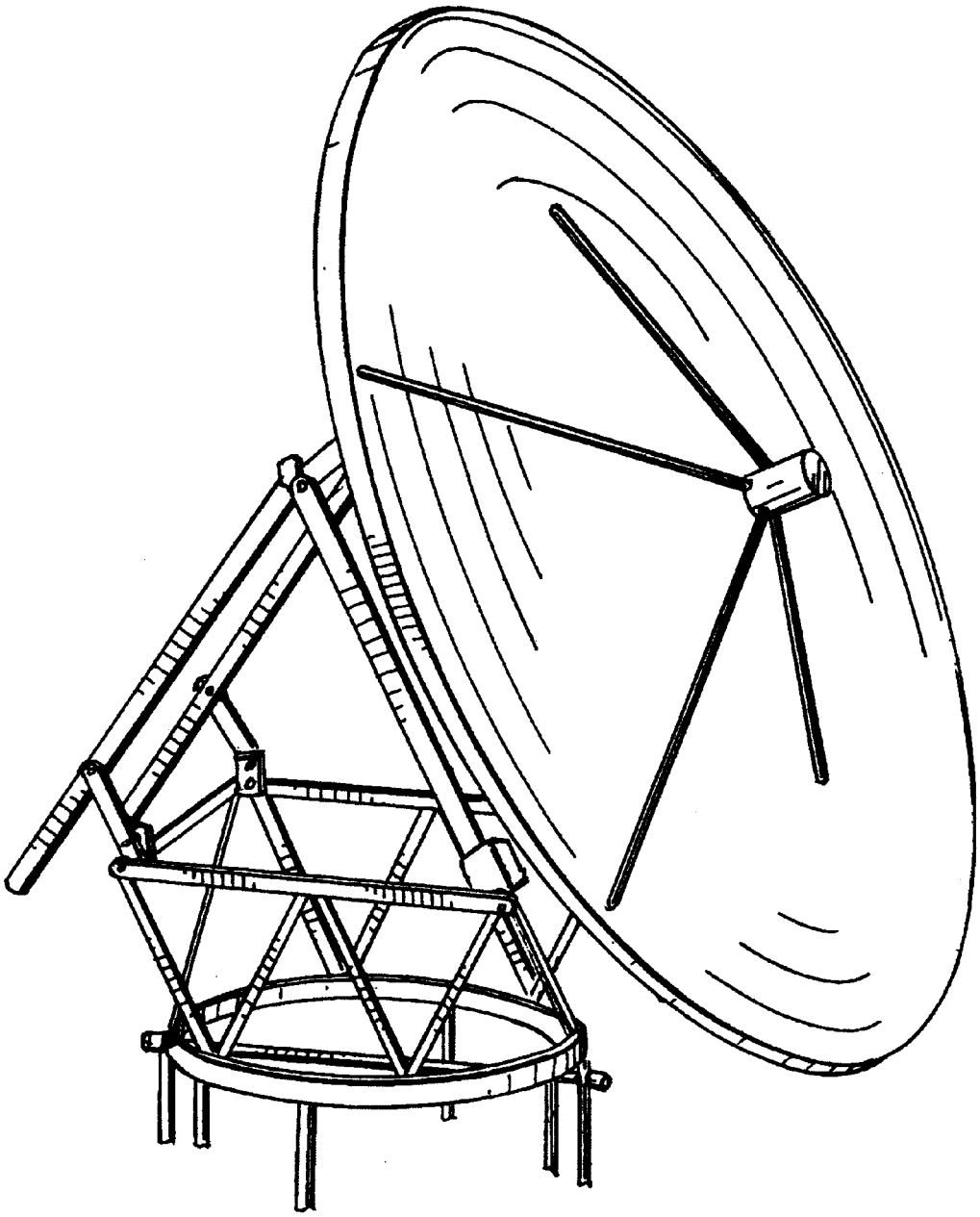
FIG. 1. (PRIOR ART)
FIG. 1 generally illustrates a prior art parabolic dish antenna.
Figure 2:
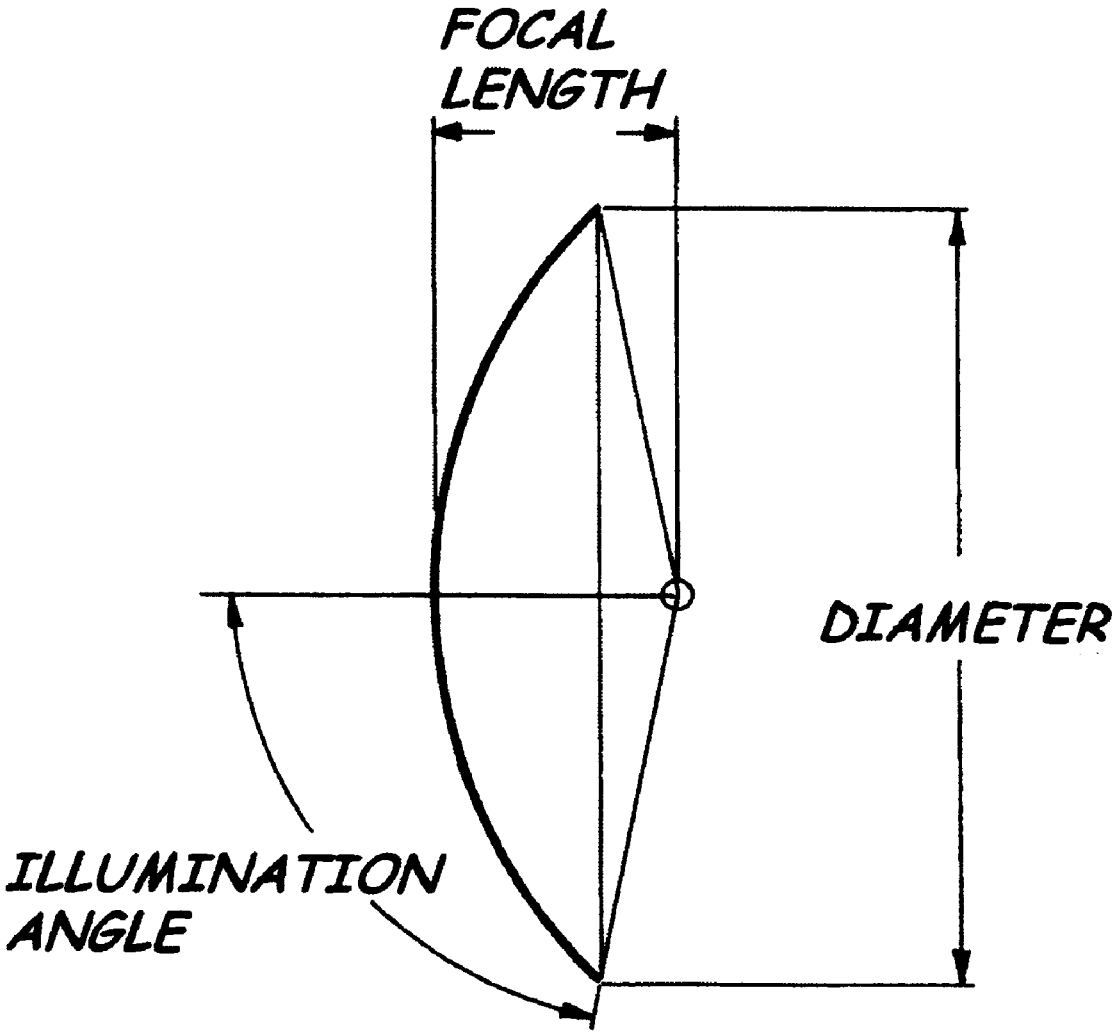
FIG. 2. (PRIOR ART)
FIG. 2 shows a schematic cross-sectional side view of a prior art parabolic dish antenna.
Figure 3:
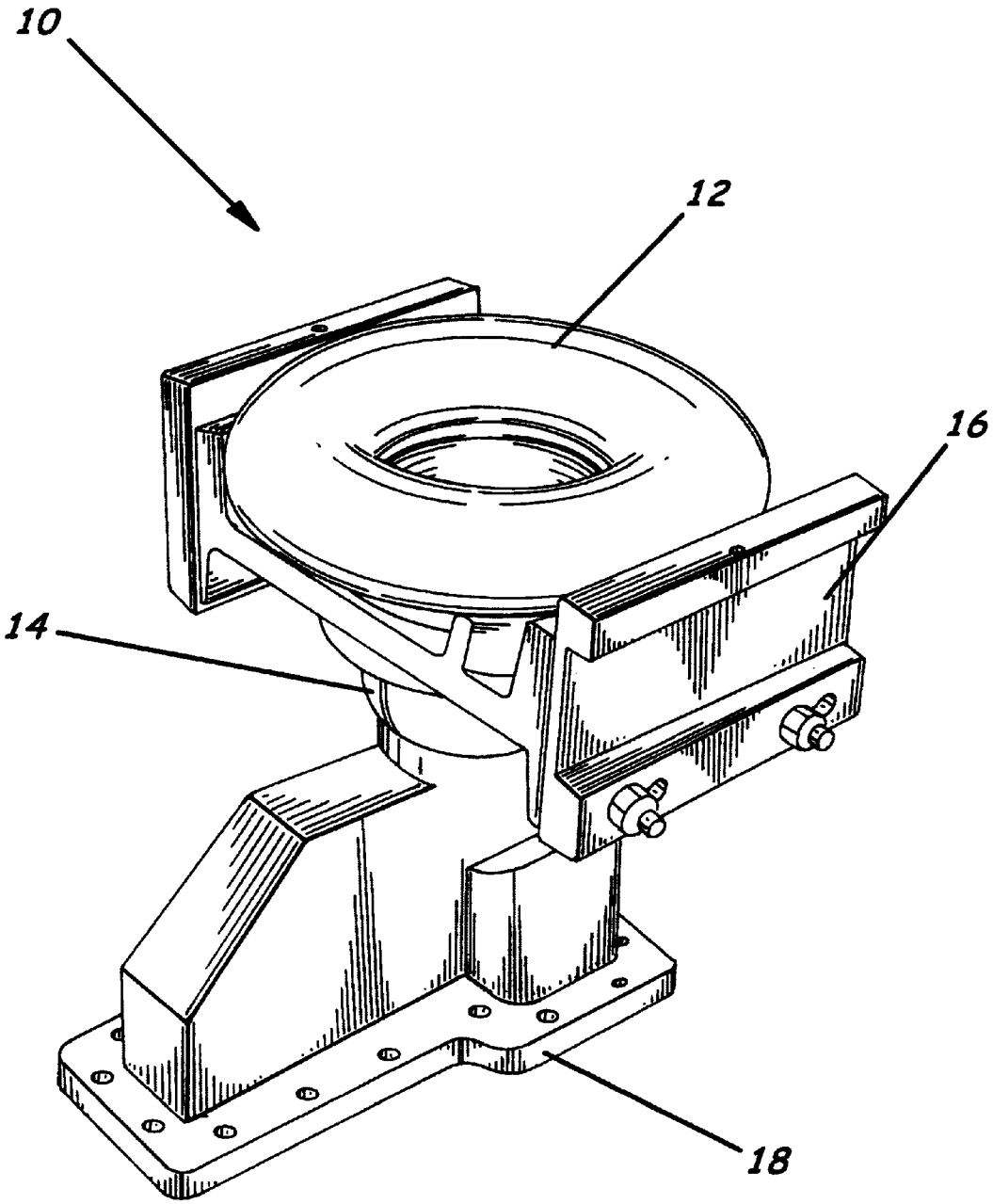
FIG. 3 is a perspective view of the antenna feed system of the present invention.

The corrective dielectric lens feed system 10 includes the dielectric lens 12, a circular waveguide 14, a scalar plate 16, and an orthomode coupler 18. The shape of the corrective dielectric lens 12 is half a donut sliced through the plan of the donut. The interior half donut hole diameter is made approximately equal to the interior input waveguide 14 diameter. The outside diameter is chosen by experiment and is related to the donut material dielectric constant and feed frequency. The donut cross-section in a plane through the diameter is half-circular when split down the middle. The corrective dielectric half donut shaped lens is positioned outside the feed with interior donut hole concentric to the input waveguide 14. An example of the device according to an embodiment of the present invention is shown in FIG. 3. The same type corrective dielectric lens has been shown to work on many different feed types including those without a scalar plate 16 (just open-ended waveguide), both circular and non-circular feeds.

At this time we do not have a theory which satisfactorily explains the operation of the device of the invention. From an electromagnetic theory point of view, one would not expect the lens to do much since it is situated outside the waveguide aperture opening.

That which is claimed is:

1. An apparatus for broadening the radiation pattern of a waveguide horn, comprising:

an input waveguide feed including a non-circular waveguide horn having an aperture; and a dielectric lens shaped as a toroid having an interior opening and an outside circumference, said toroid being cut along an imaginary plane extending generally parallel to a diameter of the toroid and being positioned generally coaxially adjacent the non-circular aperture.

2. The apparatus of claim 1, wherein said aperture is selected from a circular aperture and a non-circular aperture.

3. The apparatus of claim 1, wherein said dielectric lens comprises a low-loss dielectric material.

4. The apparatus of claim 1, wherein said dielectric lens comprises dimensions sufficient for reducing antenna roll-off by about half.

5. The apparatus of claim 1, wherein said dielectric lens comprises dimensions sufficient for reducing antenna roll-off from approximately 20 dB to approximately 10 dB.

6. The apparatus of claim 1, wherein said input waveguide feed has an interior input diameter, and wherein said toroid has an interior opening diameter approximately equal to the interior input diameter of said input waveguide feed.

7. The apparatus of claim 1, wherein said toroid comprises an outside diameter having a dimension predetermined by feed frequency and dielectric constant of material in said toroid.

8. The apparatus of claim 1, wherein said dielectric lens is positioned out side the input waveguide feed and having the interior opening adjacently concentric to the input waveguide feed.

9. The apparatus of claim 1, further comprising a scalar plate positioned adjacent said input waveguide feed.

10. The apparatus of claim 1, further comprising a scalar plate positioned between said input waveguide feed and said dielectric lens.

11. The apparatus of claim 1, wherein said dielectric lens comprises a plurality of component parts assembled together to form said dielectric lens.

* * * * *